US009012010B2

(12) United States Patent
Yano et al.

(10) Patent No.: US 9,012,010 B2
(45) Date of Patent: Apr. 21, 2015

(54) NANOFIBER SHEET AND METHOD FOR MANUFACTURING THE SAME

(75) Inventors: Hiroyuki Yano, Kyoto (JP); Masaya Nogi, Kyoto (JP)

(73) Assignee: Rohm Co., Ltd., Kyoto-shi (JP)

( * ) Notice: Subject to any disclaimer, the term of this patent is extended or adjusted under 35 U.S.C. 154(b) by 504 days.

(21) Appl. No.: 13/001,879

(22) PCT Filed: Jun. 26, 2009

(86) PCT No.: PCT/JP2009/061723

§ 371 (c)(1),
(2), (4) Date: Dec. 29, 2010

(87) PCT Pub. No.: WO2010/001829

PCT Pub. Date: Jan. 7, 2010

(65) Prior Publication Data

US 2011/0117319 A1 May 19, 2011

(30) Foreign Application Priority Data

Jun. 30, 2008 (JP) ..... 2008-169959

(51) Int. Cl.

| | |
|---|---|
| ***D04H 1/00*** | (2006.01) |
| ***D21H 11/08*** | (2006.01) |
| ***D21H 27/06*** | (2006.01) |
| ***B31F 1/00*** | (2006.01) |

(52) U.S. Cl.

CPC ..... *D21H 11/08* (2013.01); *D21H 5/0077* (2013.01); *B31F 1/0035* (2013.01); *B65H 2301/51232* (2013.01)

(58) Field of Classification Search

CPC ..... D21H 11/00; D21H 11/08; D21H 11/20; D21H 21/26; D21H 5/0077; B31F 1/0035; B65H 2301/51232; B65H 2301/51256; C08L 1/02; B29C 43/24; B29C 2059/027

USPC ..... 428/141, 292.1, 292.4

See application file for complete search history.

(56) References Cited

U.S. PATENT DOCUMENTS

| | | | | |
|---|---|---|---|---|
| 2009/0264036 | A1 * | 10/2009 | Yano et al. | 442/165 |
| 2009/0305033 | A1 * | 12/2009 | Yano et al. | 428/339 |

FOREIGN PATENT DOCUMENTS

| | | | |
|---|---|---|---|
| JP | 7 156279 | | 6/1995 |
| JP | 9 207234 | | 8/1997 |
| JP | 2003 155349 | | 5/2003 |
| JP | 2005 60680 | | 3/2005 |
| JP | 2007 51266 | | 3/2007 |
| JP | 2007 91965 | | 4/2007 |
| JP | 2008 7646 | | 1/2008 |
| JP | 2008 24788 | | 2/2008 |
| WO | 2008 010462 | | 1/2008 |
| WO | WO 2008010449 | A1 * | 1/2008 |
| WO | WO 2008010462 | A1 * | 1/2008 |

OTHER PUBLICATIONS

Office Action issued Jan. 29, 2013, in Japanese Patent Application No. 2008-169959.

International Search Report issued Oct. 13, 2009 in PCT/JP09/61723 filed Jun. 26, 2009.

Japanese Office Action issued May 14, 2013 in Patent Application No. 2008-169959.

* cited by examiner

*Primary Examiner* — Maria Veronica Ewald
*Assistant Examiner* — Nancy Johnson
(74) *Attorney, Agent, or Firm* — Oblon, McClelland, Maier & Neustadt, L.L.P.

(57) ABSTRACT

A nanofiber sheet that has a high degree of transparency, a high modulus of elasticity, a low coefficient of linear thermal expansion as well as high degrees of flatness and smoothness, in particular, a nanofiber sheet produced as a uniform and flat sheet having a high optical transmittance with cellulose as the only component. This sheet has the following characteristics: Calculated for a thickness of 60 μm, the transmittance for parallel rays of light having a wavelength of 600 nm is equal to or higher than 70%; The Young's modulus measured in accordance with the JIS K7161 method is equal to or greater than 10 GPa; The coefficient of linear thermal expansion measured in accordance with the ASTM D606 method is equal to or smaller than 10 ppm/K.

14 Claims, No Drawings

NANOFIBER SHEET AND METHOD FOR MANUFACTURING THE SAME

CROSS-REFERENCE TO RELATED APPLICATIONS

This application is a US National Stage Application of PCT/JP2009/061723, filed on Jun. 26, 2009, the text of which is incorporated by reference, and claims priority to Japanese Patent Application 2008-169959, filed on Jun. 30, 2008, the text of which is also incorporated by reference.

FIELD OF INVENTION

The present invention relates to nonwoven fabrics composed of nanofiber (hereinafter, referred to as "nanofiber sheets") and methods for manufacturing them and relates to a nanofiber sheet produced as a uniform and flat sheet having a high modulus of elasticity, a low coefficient of linear thermal expansion, and a high optical transmittance with cellulose as the only component, and a method for manufacturing it.

BACKGROUND OF INVENTION

As the most popular one of fiber-reinforced composite materials, fiber-glass-reinforced resin, which is fiber glass impregnated with resin, has been known. In general, fiber-glass-reinforced resin is nontransparent. Methods for obtaining transparent fiber-glass-reinforced resin, in which the refractive index of fiber glass and that of the resin matrix are matched, have been disclosed in patent documents 1 and 2.

Incidentally, transparent flexible substrates used for implementation of LED or organic electronics devices are required to have properties such as a weak tendency for thermal expansion as well as a high strength, a high elasticity, and a light weight. However, fiber-glass-reinforced resin substrates can have a weak tendency for thermal expansion and a high strength but cannot have a light weight. Also, in the ordinary way of fiber glass reinforcement, the fiber diameter is on the order of microns, and thus resultant substrates can be transparent only at a specific atmospheric temperature and for a specific wavelength range, and transparency is insufficient in practical settings. Furthermore, changes in atmospheric temperature may affect flatness and surface smoothness.

Patent document 3 mentioned below describes a flexible fiber-reinforced composite substrate material that is excellently transparent regardless of temperature, range of wavelength in the visible range, or the refractive index of the resin material used in combination therewith, is excellent in terms of surface smoothness, has a weak tendency for thermal expansion as well as a high strength and a light weight. This fiber-reinforced composite material contains fiber having an average fiber diameter in the range of 4 to 200 nm and a matrix material, and the transmittance for rays of light having a wavelength in the range of 400 to 700 nm calculated for a thickness of 50 μm is equal to or higher than 60%.

For improved hygroscopicity of this fiber-reinforced composite material, hydroxy groups of cellulose fiber, a constituent of the fiber-reinforced composite material, are chemically modified; the resultant fiber-reinforced composite material is described in PATENT DOCUMENT 4.

In patent documents 3 and 4, cellulose fiber produced by bacteria (hereinafter, referred to as "bacteria cellulose") or cellulose fiber obtained by unbraiding pulp, cotton, or some other similar material into microfibrils is processed into a sheet, and then the sheet is impregnated with a matrix material.

Also, patent documents 5 and 6 have proposed ultrafine fiber obtained by suspending cellulose fiber or some other kind of naturally occurring fiber and then processing the suspension between two rotating discs for unbraiding. In these literatures, patent documents 5 and 6, fiber is fragmented by mechanical unbraiding cycles repeated 10 to 20 times.

To obtain a highly transparent fiber-reinforced composite material by impregnation of a fine-fiber sheet with a matrix material, such as those described in patent documents 3 to 6, it is required that the fiber constituting the sheet be fragmented into sufficiently small pieces (nanofiber). And, to obtain a fiber-reinforced composite material with a high modulus of elasticity and a low coefficient of linear thermal expansion, it is required that cellulose crystals constituting the fiber cannot be broken by unbraiding and keep its high degree of crystallinity even after unbraiding.

To this end, in patent document 6, the precursor of nanofiber is conditioned before unbraiding to contain water at a predefined content ratio so that it can be prevented from drying; as a result, a nanofiber sheet is obtained with sufficiently small fiber pieces.

Patent document 1: Japanese Unexamined Patent Application Publication No. 9-207234

Patent document 2: Japanese Unexamined Patent Application Publication No. 7-156279

Patent document 3: Japanese Unexamined Patent Application Publication No. 2005-60680

Patent document 4: Japanese Unexamined Patent Application Publication No. 2007-51266

Patent document 5: Japanese Unexamined Patent Application Publication No. 2003-155349

Patent document 6: Japanese Unexamined Patent Application Publication No. 2008-24788

SUMMARY OF INVENTION

The composite materials described in patent documents 3 to 6, fine-fiber sheets impregnated with a matrix material, all necessitate that a fine-fiber sheet and a transparent-resin matrix material are processed into a composite material for a high degree of transparency. However, transparent resins have high coefficients of linear thermal expansion and low moduli of elasticity. Thus, compared with materials based only on cellulose, composite materials composed of cellulose and transparent resin have high coefficients of linear thermal expansion and low moduli of elasticity.

The present invention is intended to solve the current problems described above by providing a nanofiber sheet having a high degree of transparency, a high modulus of elasticity, a low coefficient of linear thermal expansion as well as high degrees of flatness and smoothness, in particular, a uniform and flat sheet having a high optical transmittance, with cellulose as the only component.

The present inventors had made extensive research to solve the problems described above and found that making the surface of a nanofiber sheet prevents light scattering on the surface and, as a result, a highly transparent nanofiber sheet can be obtained with a high modulus of elasticity and a low coefficient of linear expansion with no processing of fiber and a matrix material into a composite material needed.

The present invention is based on these findings, and the gist thereof is as follows.

[1] A nonwoven fabric composed of nanofiber (hereinafter, referred to as a "nanofiber sheet") having the following characteristics (1) to (3):

(1) Calculated for a thickness of 60 μm, the transmittance for parallel rays of light having a wavelength of 600 nm is equal to or higher than 70%;

(2) The Young's modulus measured in accordance with the JIS K7161 method is equal to or greater than 10 GPa; and (3) The coefficient of linear thermal expansion measured in accordance with the ASTM D606 method is equal to or smaller than 10 ppm/K.

[2] The nanofiber sheet according to [1], wherein the average surface roughness (Ra) is equal to or smaller than 90 nm on at least either one surface.

[3] The nanofiber sheet according to [1] or [2], wherein the transmittance for all rays of light having a wavelength of 250 nm is equal to or higher than 5%.

[4] The nanofiber sheet according to any of [1] to [3], wherein the content ratio of cellulose in the sheet is equal to or higher than 90 weight %.

[5] The nanofiber sheet according to any of [1] to [4], wherein the nanofiber is obtained from wood particles.

[6] The nanofiber sheet according to [4] or [5], wherein some of hydroxy groups of the cellulose have undergone a chemical modification.

[7] The nanofiber sheet according to [6], wherein the chemical modification is performed using one or two or more kinds selected from the group consisting of acids, alcohols, halogenizing reagents, acid anhydrides, and isocyanates.

[8] A method for manufacturing the nanofiber sheet according to any of [1] to [7], including a step for performing a physical surface-smoothing treatment.

[9] The method for manufacturing a nanofiber sheet according to [8], wherein the surface-smoothing treatment is performed by polishing or pressing.

[10] The method for manufacturing a nanofiber sheet according to [8] or [9], further including an unbraiding step for unbraiding a nanofiber precursor, wherein the water content ratio in the nanofiber precursor is equal to or higher than 3 weight % in all steps preceding the unbraiding step.

[11] The method for manufacturing a nanofiber sheet according to [10], wherein the unbraiding step is a step in which a nanofiber precursor solution or dispersion having a solid content ratio in the range of 0.1 to 5 weight % is unbraided into nanofiber.

[12] The method for manufacturing a nanofiber sheet according to [10] or [11], further including, before the unbraiding step, a lignin removal step in which the nanofiber precursor is immersed in an oxidizing agent.

[13] The method for manufacturing a nanofiber sheet according to any of [10] to [12], further including a drying step for drying the nanofiber obtained in the unbraiding step until the water content ratio is lower than 3 weight %.

[14] The method for manufacturing a nanofiber sheet according to any of [10] to [13], further including a hemicellulose removal step in which the nanofiber precursor is immersed in an alkali.

[15] The method for manufacturing a nanofiber sheet according to any of [10] to [14], further including a sheet-making step for processing the nanofiber obtained in the unbraiding step into a sheet.

[16] The method for manufacturing a nanofiber sheet according to any of [10] to [15], further including a chemical modification step for chemically modifying some of hydroxy groups of the cellulose obtained in the unbraiding step.

The nanofiber sheet according to the present invention has undergone a physical surface-smoothing treatment and other steps for improved surface smoothness and flatness and thus has a high degree of transparency by itself; as it needs no combination with a matrix material into a composite material, its modulus of elasticity is high, and its coefficient of linear thermal expansion is low.

More specifically, to obtain a transparent sheet, it is required that scattering be suppressed both in the sheet and on the surface. In the present invention, a nanofiber sheet having a low porosity and thus allowing for only a small extent of light scattering inside has its surface smoothed, and this suppresses light scattering on the surface as well; as a result, a high degree of transparency can be achieved. Thus, the nanofiber sheet needs no combination with a matrix material into a composite material, and this makes it possible to obtain a highly transparent material while preserving the original modulus of elasticity and rate of linear thermal expansion of the nanofiber sheet. Furthermore, nanofiber sheets obtained in this way are also excellent in terms of heat resistance.

As described above, it has been traditionally required for a high degree of transparency that a nanofiber sheet and a matrix material be processed into a composite material. In the present invention, however, the nanofiber sheet provides a transparent sheet by itself with no processing into a composite material needed. This eliminates the need for a step for processing the nanofiber sheet to prepare a composite material and thus makes it possible to obtain a sheet whit a coefficient of linear expansion and a modulus of elasticity higher than those of composite materials. Furthermore, the absorption of ultraviolet light into resin is suppressed, and this makes it possible to obtain a sheet that allows rays of light having a wavelength equal to or shorter than 300 nm to pass therethrough with a high total intensity.

DETAILED DESCRIPTION

The following explains the present invention in detail.

[Physical Properties and Other Characteristics of Components]

The details and measuring methods of the physical properties, characteristics, and other profiles of the components specified in the present invention are as follows. Note that the measuring methods are more specifically described in the Examples section.

1) Transmittance for all Rays of Light

The transmittance for all rays of light of a nanofiber sheet is a transmittance for all rays of light measured for a nanofiber sheet prepared in accordance with the method described later in the Examples section under irradiation in the thickness direction with light having a wavelength of 600 nm. The transmittance for all rays of light can be determined in the following way: A light source and a detector are arranged putting the substrate under measurement (test substrate) therebetween and perpendicular to the substrate, and the transmittance for all rays of light is measured with air as the reference.

For the nanofiber sheets and the composite materials described as comparative examples, the transmittance for all rays of light is measured in the same way.

2) Transmittance for Parallel Rays of Light

The transmittance for parallel rays of light of a nanofiber sheet is a transmittance for parallel rays of light (a transmittance for linear rays of light) measured for a nanofiber sheet prepared in accordance with the method described later in the Examples section under irradiation in the thickness direction with light having a wavelength of 600 nm. The transmittance for parallel rays of light can be determined in the following way: A light source and a detector are arranged putting the substrate under measurement (test substrate) therebetween and perpendicular to the substrate, and the transmittance for all rays of light is measured with air as the reference and the detector positioned far from the substrate under measurement enough for detection of parallel rays of light (linear transmitted light) only.

For the nanofiber sheets and the composite materials described as comparative examples, the transmittance for parallel rays of light is measured in the same way.

When the thickness of the nanofiber sheet is not 60 μm, the transmittance for parallel rays of light (%) at a thickness of 60 μm can be determined from the transmittance for parallel rays of light (%) of the nanofiber sheet or some other kind of test specimen having a different thickness (D μm) in accordance with the proportion provided below. This applies to the transmittance for all rays of light (%) as well.

$$\text{Transmittance for parallel rays of light at a thickness of 60 } \mu\text{m} = 100 \times (\text{Transmittance for parallel rays of light at a thickness of D } \mu\text{m}/100)^{(60/D)}$$

3) Young's Modulus

In accordance with the JIS K7161 method, a test specimen shaped to have a width of 5 mm, a length of 50 mm, and a thickness of 50 μm undergoes tensile test with the rate of deformation set at 5 mm/min. Then, the Young's modulus is determined from the stress to the strain under the conditions of proportionality limit or milder conditions.

4) Coefficient of Linear Thermal Expansion

This is a coefficient of linear thermal expansion measured while a test specimen is heated from 20° C. to 150° C. and is measured under the conditions specified in ASTM D696.

5) Average Surface Roughness (Ra) and Maximum Difference in Height

The average surface roughness (Ra) is determined in the following way: With an SPI 3800N scanning probe microscope (manufactured by SII NanoTechnology Inc.) set in the DFM mode, a surface roughness on a 20 μm square is scanned with respect to the surface of the test specimen.

In addition, the maximum difference in height (the sum of the depth of the deepest depression and the height of the tallest projection on the surface of the test specimen) can also be determined in this measurement task.

6) Degree of Chemical-Modification-Induced Substitution of Hydroxy Groups

The degree of substitution, a measure of how many hydroxy groups have been substituted in cellulose, is the number of the introduced substituents per the three hydroxy groups existing in an anhydroglucose unit. For example, the degree of substitution (DS) with acetyl groups is determined by the following formula:

$$DS = \{(\text{Weight of the sheet after reaction})/(\text{Weight of the sheet before reaction}) \times 162.14 - 162.14\}/42$$

Note that each weight of the sheet is calculated as a value for a cellulose sheet, without taking into account lignin and hemicellulose.

7) Wood Particle Size

The major axis and the major axis/minor axis ratio of each wood particle are determined as follows.

The major axis is measured by microscopic observation of a test specimen.

The minor axis is also measured in the same way, and the result is used to calculate the major axis/minor axis ratio.

In addition, the minor axis can be measured in a different way, by allowing wood particles under measurement to pass through a sieve having a predetermined mesh size. When coagulation makes it difficult to measure the wood particle size, drying may improve the situation.

8) Water Content Ratio

A test specimen is brought into the absolute dry state, by heating if necessary, and then the water content ratio is determined from the difference between the initial weight and the resultant weight.

For example, wood particles, which cannot be in the absolute dry state at room temperature, are heated. Specifically, wood particles come into the complete dry state after being allowed to stand in an oven at 105° C. overnight, thereby making it possible to determine the water content ratio from the difference between the initial weight and the resultant weight.

9) Determination Method for Lignin

The lignin content ratio was measured by the sulfuric acid method as follows:

A weighing bottle and a glass filter are weighed in advance (total weight of the glass filter and the weighing bottle: Mg). About 1 g of a test specimen, accurately weighed (weight of the test specimen: Mr), is transferred to a 100-ml beaker, 15 ml of 72% sulfuric acid at about 20° C. is added, and the obtained mixture is vigorously stirred and then allowed to stand at 20° C. for four hours. The obtained product is transferred to a 1000-ml Erlenmeyer flask with 560 ml of distilled water, and then, with a reflux condenser set in position, the obtained mixture is boiled for four hours. After being allowed to cool, the content is suction-filtered through the glass filter; then, the residue is washed with 500 ml of hot water. The glass filter is placed in the weighing bottle, is dried at 105° C. to a constant weight, and then weighed (measured weight: Mn).

The lignin content ratio is determined by the following formula:

$$\text{Lignin content ratio (weight \%)} = (Mn - Mg)/Mr \times 100$$

10) Determination Method for Hemicellulose

The following steps were carried out.

About 1 g of a test specimen, accurately weighed, is put into a 200-ml beaker (weight of the test specimen: Mh), and then 25 ml of 17.5 weight % sodium hydroxide solution at 20° C. is added. The test specimen is allowed to damp uniformly and stand for four minutes thereafter, and then crushed with a glass rod for five minutes for dissociation sufficient for uniform absorption of alkali solution. The beaker is covered with a watch glass and then allowed to stand. The operation described above is performed in a thermostat water bath at 20° C.

Thirty minutes after the addition of sodium hydroxide aqueous solution, distilled water at 20° C. is added by pouring under stirring with a glass rod. After being stirred for another one minute, the mixture is allowed to stand in a thermostat water bath at 20° C. for five minutes and then suction-filtered through a glass filter weighed in advance. The filtrate is returned to the beaker and filtered once again (the whole filtration process should be completed in five minutes), and then, no later than five minutes, the residue is washed with distilled water under squeeze with a glass rod. The end point of washing is the washing cycle after which the washing is neutral as indicated by phenol phthalein. Onto the washed residue, 40 ml of 10 weight % acetic acid is poured; then, after being allowed to stand for five minutes, the mixture is washed with 1 L of distilled water. The residue is dried at 105° C. to a constant weight and then weighed (measurement: Mz).

The hemicellulose content ratio is determined by the following formula:

$$\text{Hemicellulose content ratio (weight \%)} = (Mh - Mz)/Mh \times 100$$

11) Tensile Strength

With a test specimen having a thickness of 50 μm, a width of 5 mm, and a length of 50 mm, the tensile strength is measured in accordance with the method specified in JIS K7161 with the rate of deformation set at 5 mm/min.

12) Porosity

The porosity e is calculated by the following formula:

$$e=(V_s-G_s/d_f)/V_s$$

$V_s$: Volume of the nanofiber sheet $G_s$: Weight of the nanofiber sheet $d_f$: Density of nanofiber $V_s$ is calculated by the following formula:

$V_s=S_s \cdot t_s$ $S_s$: Plane area of the nanofiber sheet $t_s$: Thickness of the nanofiber sheet

[Nanofiber Sheet]

The nanofiber sheet according to the present invention is a nanofiber sheet that satisfies the following characteristics i) to iii). Note that when the nanofiber sheet has in-plane anisotropy, it is preferable that the characteristic values averaged for two directions satisfy the following requirements.

i) Calculated for a thickness of 60 μm, the transmittance for parallel rays of light having a wavelength of 600 nm is equal to or higher than 70%.

ii) The Young's modulus is equal to or greater than 10 GPa.

iii) The coefficient of linear thermal expansion is equal to or smaller than 10 ppm/K.

<Transmittance for Parallel Rays of Light>

In the present invention, the nanofiber sheet is characterized in that the transmittance for parallel rays of light having a wavelength of 600 nm, calculated for a thickness of 60 μm, is equal to or higher than 70%. With this transmittance for parallel rays of light less than 70%, the nanofiber sheet cannot have the degree of transparency intended in the present invention. This transmittance for parallel rays of light is preferably equal to or higher than 80% and the most preferably equal to or higher than 90%. For the nanofiber sheet according to the present invention, the higher the transmittance for parallel rays of light, the better; however, its upper limit is usually equal to or lower than 92%.

<Young's Modulus>

In the present invention, the nanofiber sheet is characterized in that the Young's modulus measured in accordance with the JIS K7161 method is equal to or greater than 10 GPa. With this Young's modulus less than 10 GPa, the nanofiber sheet has too small a coefficient of thermal expansion, too low a modulus of elasticity, and too low a thermal conductivity in the use as a transparent material. This Young's modulus is preferably equal to or greater than 12 GPa and more preferably equal to or greater than 13 GPa. For the nanofiber sheet according to the present invention, the greater the Young's modulus, the better; however, its upper limit is usually equal to or smaller than 15 GPa.

<Coefficient of Linear Thermal Expansion>

In the present invention, the nanofiber sheet is characterized in that the coefficient of linear thermal expansion measured in accordance with the ASTM D606 method is equal to or smaller than 10 ppm/K. With this coefficient of linear thermal expansion greater than 10 ppm/K, the nanofiber sheet cannot have the weak tendency for linear thermal expansion intended in the present invention. This coefficient of linear thermal expansion is preferably equal to or smaller than 8 ppm/K and more preferably equal to or smaller than 5 ppm/K. For the nanofiber sheet according to the present invention, the greater the coefficient of linear thermal expansion, the better; however, its lower limit is usually equal to or greater than 1 ppm/K. With the coefficient of linear thermal expansion less than this lower limit, the nanofiber sheet is at risk of having unnecessary strain.

<Average Surface Roughness (Ra)>

The nanofiber sheet according to the present invention preferably has an average surface roughness (Ra) of 90 nm or less on at least either one of the front and back surfaces, in particular, on at least the surface through which light enters in the actual use of the nanofiber sheet. With this average surface roughness (Ra) exceeding 90 nm, the nanofiber sheet cannot have the high degree of transparency intended in the present invention that is brought about by surface smoothness and flatness. This average surface roughness (Ra) is preferably equal to or smaller than 40 nm and more preferably equal to or smaller than 20 nm. For the nanofiber sheet according to the present invention, the smaller the average surface roughness (Ra), the better; however, its lower limit is usually equal to or greater than 5 nm.

For a similar reason, the maximum difference in height on surface of the nanofiber sheet according to the present invention is preferably equal to or smaller than 1000 nm, in particular, equal to or smaller than 300 nm. The smaller the maximum difference in height, the better; however, its lower limit is usually equal to or greater than 50 nm.

Note that in the present invention, it is accepted that the nanofiber sheet can satisfy the above-mentioned requirement of upper limit for both average surface roughness (Ra) and the maximum difference in height on surface only on either one surface. Nevertheless, it is preferable that at least the measurement averaged for both surfaces satisfies the above-mentioned requirement of upper limit for both average surface roughness (Ra) and the maximum difference in height on surface, and it is particularly preferable that both surfaces of the nanofiber sheet satisfy the above-mentioned requirement of upper limit for both average surface roughness (Ra) and the maximum difference in height on surface. However, the nanofiber sheet does not always have to have similar values of average surface roughness (Ra) and the maximum difference in height on surface on both surfaces; the average surface roughness (Ra) and the maximum difference in height on surface may be different between one surface and the other.

<Transmittance for all Rays of Light>

The transmittance for all rays of light having a wavelength of 250 nm of the nanofiber sheet according to the present invention is preferably equal to or higher than 5%. With this transmittance for all rays of light less than 5%, the nanofiber sheet cannot have the high degree of transparency intended in the present invention. This transmittance for all rays of light is preferably equal to or higher than 10% and more preferably equal to or higher than 20%. For the nanofiber sheet according to the present invention, the higher the transmittance for all rays of light, the better; however, its upper limit is usually equal to or lower than 50%.

<Tensile Strength>

For the nanofiber sheet according to the present invention, the tensile strength is preferably equal to or greater than 180 MPa and more preferably equal to or greater than 210 MPa. Any tensile strength smaller than 150 MPa makes it impossible to obtain a sufficient strength level and may affect the use of the nanofiber sheet in high-load applications, such as the use as a structural material. The upper limit of tensile strength is usually on the order of 400 MPa; however, it is also expected that a high tensile strength of 10 GPa, or a tensile strength as high as 15 GPa, will be achieved by adjusting the fiber orientation or other improvement measures.

<Porosity>

With too high a porosity, the nanofiber sheet allows a high level of light scattering to occur inside and thus cannot have a favorable degree of transparency. The porosity of the nanofiber sheet is preferably equal to or lower than 10%, in particular, equal to or lower than 5%.

<Raw Material of Nanofiber>

Nanofiber constituting the nanofiber sheet according to the present invention is preferably obtained from wood particles.

In other words, bacteria cellulose, which is described in patent documents 3 and 4 mentioned above, is costly, cannot be easily processed into uniform sheets with no crinkles or warp, and have some other problems such as a high degree of birefringence.

Also, cotton, which contains no lignin or hemicellulose, cannot be effectively unbraided by mechanical means. For example, with cotton, unbraiding by grinder treatment takes ten or more times longer unbraiding treatment period than with wood particles, and cellulose crystals are broken and the crystallinity is problematically decreased.

Likewise, pulp, which needs to be dried, cannot be effectively unbraided by mechanical means. Note that the water content ratio in pulp is usually on the order of 10 weight % at room temperature.

On the other hand, wood particles can be mechanically unbraided with no drying needed after appropriate lignin removal treatment and hemicellulose removal treatment, as described later. This eliminates the need for excessively long unbraiding treatment that may break cellulose crystals, thereby making it possible to produce nanofiber while maintaining a high degree of crystallinity. Furthermore, unlike bacteria cellulose, wood particles contain no branched filaments and thus cannot be easily processed into uniform sheets with no crinkles or warp and with a reduced intensity of birefringence.

Particles of wood, particles of bamboo, and similar kinds of particles are suitably used as raw material wood particles. Among others, particles each having a major axis in the range of 30 μm to 2 mm are particularly suitable. With too long a major axis, the wood particles may be insufficiently unbraided downstream during the mechanical braiding step. With too short a major axis, the wood particles may lose their intended advantages because grinding breaks cellulose crystals and decreases the degree of crystallinity to an insufficient level.

The upper limit of the major axis of the wood particles is preferably equal to or shorter than 2 mm, more preferably equal to or shorter than 1 mm, and the most preferably equal to or shorter than 500 μm. And, the lower limit of the major axis of the wood particles is preferably equal to or longer than 30 μm, more preferably equal to or longer than 50 μm, and the most preferably equal to or longer than 100 μm.

Too large ratio of length of the major axis to the minor axis of the wood particles is unfavorable because it makes the wood particles difficult to process a grinder. Expressed in major axis/minor axis, the ratio is preferably equal to or smaller than 40, more preferably equal to or smaller than 20, and the most preferably equal to or smaller than 10. Usually, this ratio is equal to or greater than 1.

Also, the raw material wood particles of nanofiber preferably have a water content ratio equal to or higher than 3 weight %. In wood particles having a water content ratio less than 3 weight %, filaments of cellulose fiber are close to each other, and thus more hydrogen bonds are formed between the filaments, reducing the mechanical unbraiding effectiveness and leading to insufficient unbraiding. With a water content ratio exceeding 70 weight %, the wood particles are so brittle that they cannot be easily handled and conveyed.

Particles of bamboo, particles of coniferous wood, particles of broadleaf tree wood, and similar kinds of particles can be suitably used as the wood particles. For the removal of lignin, however, particles of coniferous wood are advantageous because lignin can be removed therefrom in a simple way.

Wood particles that satisfy the above-described suitable characteristics can be procured from broadleaf trees, conifers, bamboo trees, kenaf trees, palm trees, and similar kinds of plants. However, it is preferable that the wood particles are procured from the trunk or branches of broadleaf trees or conifers.

<Cellulose Content Ratio>

For the nanofiber sheet according to the present invention, the cellulose content ratio is preferably equal to or higher than 90 weight %. With a cellulose content ratio less than 90 weight %, the nanofiber sheet seriously yellows on heating.

The cellulose content ratio in the nanofiber sheet according to the present invention is more preferably equal to or higher than 93 weight % and particularly preferably equal to or higher than 99 weight %.

<Lignin Content Ratio>

If the nanofiber sheet contains lignin at a high content ratio and lignin is insufficiently removed during the lignin removal step, which will be described later, then the effect of increasing the mechanical unbraiding efficiency, which is exercised with voids left after the removal of lignin as a trigger for mechanical unbraiding, is insufficient.

With a lignin content ratio higher than 10 weight %, the nanofiber sheet is unfavorable because residual lignin causes discoloration during high-temperature treatment at 180° C. or a higher temperature. The high-temperature treatment at 180° C. or a higher temperature is for heating treatment usually required in processes such as a film-forming step for transparent conductive films, a baking step in photolithographic processes, and drying and hardening treatment and treatment for the removal of low-molecular-weight components and residual solvent for transparent or luminescence coating materials. Thus, heat resistance at 180° C. or a higher temperature is an important property for materials used as organic device substrate materials or transparent materials. In the present invention, therefore, the lignin content ratio in the nanofiber sheet is preferably equal to or lower than 10 weight %.

Lignin acts like a plasticizer during the mechanical unbraiding step, which will be described later; thus, some amount of lignin is needed for improved mechanical unbraiding effectiveness. When the lignin content ratio is lower than 10 ppm, the formation of nanofiber by mechanical unbraiding is often insufficient. In the present invention, therefore, the lignin content ratio in the nanofiber sheet is preferably equal to or higher than 10 ppm.

The lower limit of the lignin content ratio in the nanofiber sheet is preferably equal to or higher than 20 ppm, more preferably equal to or higher than 50 ppm, and the most preferably equal to or higher than 100 ppm. The upper limit is preferably equal to or lower than 7 weight % and more preferably equal to or lower than 5 weight %.

<Hemicellulose Content Ratio>

For the nanofiber sheet according to the present invention, there is no particular limitation on the hemicellulose content ratio. However, nanofiber sheets with a high hemicellulose content ratio have some problems when used as transparent sheets, for example, an insufficiently reduced coefficient of thermal expansion, a reduced modulus of elasticity, and a reduced coefficient of heat conductivity. On the other hand, nanofiber sheets with a low hemicellulose content ratio are often obtained with unbraiding incomplete because of a mechanism similar to, although with less seriousness, that for nanofiber sheets mixed with lignin. Therefore, the hemicellulose content ratio is preferably equal to or lower than 10 weight %, in particular, equal to or lower than 7 weight %, and preferably equal to or higher than 100 ppm, in particular, equal to or higher than 200 ppm.

<Chemical Modification>

Cellulose as a constituent of the nanofiber sheet according to the present invention may have some of its hydroxy groups chemically modified. This chemical modification of hydroxy groups improves heat resistance, heightens the decomposition temperature, prevents discoloration, lowers the coefficient of linear thermal expansion, and reduces hygroscopicity.

There is no particular limitation on substituents introduced by this chemical modification to replace hydroxy groups. For example, one or two or more kinds are selected from the following groups: acetyl group, propanoyl group, butanoyl group, iso-butanoyl group, pentanoyl group, hexanoyl group, heptanoyl group, octanoyl group, nonanoyl group, decanoyl group, undecanoyl group, dodecanoyl group, myristoyl group, palmitoyl group, stearoyl group, pivaloyl group, and other similar groups. A preferable chemical modification is acylation.

As for the degree of chemical modification, when the rate of chemical-modification-induced substitution of hydroxy groups is too low, the effect of improving heat resistance, hygroscopicity, and other characteristics by the chemical modification may be insufficient. Also, when the rate of chemical-modification-induced substitution of hydroxy groups is too high, cellulose crystals contained in nanofiber may be broken during the treatment step for this chemical modification. Therefore, the degree of substitution mentioned above is preferably equal to or lower than 1.2 and more preferably equal to or lower than 0.8, in particular, equal to or lower than 0.6, and preferably equal to or higher than 0.05 and more preferably equal to or higher than 0.2, in particular, equal to or higher than 0.4.

[Method for Manufacturing the Nanofiber Sheet]

The method for manufacturing a nanofiber sheet according to the present invention is a method for manufacturing any type of nanofiber sheet according to the present invention like the one described above and includes a step for performing a physical surface-smoothing treatment. Preferably, this method further includes an unbraiding step for mechanically unbraiding a nanofiber precursor, such as wood particles, into nanofiber. Specifically, this method is performed by Steps a) to h) listed below. In all steps preceding f), the mechanical unbraiding step, it is preferable that the water content ratio in the nanofiber precursor is equal to or higher than 3 weight %, in other words, never falls below 3 weight %. The water content ratio in the nanofiber precursor is preferably equal to or higher than 4 weight % and more preferably equal to or higher than 5 weight %. Once the nanofiber precursor goes through one or more steps in which the water content ratio therein is too low, filaments of cellulose fiber are close to each other, and thus more hydrogen bonds are formed between the filaments, reducing the mechanical unbraiding effectiveness and leading to insufficient unbraiding.

a) Defatting step
b) Lignin removal step
c) Washing step
d) Hemicellulose removal step
e) Water-washing step
f) Mechanical unbraiding step
g) Sheet-making step
h) Physical surface-smoothing treatment step This method may further include a chemical modification step for chemically modifying hydroxy groups of cellulose after the sheet-making step, g), and before the physical surface-smoothing treatment step, h). This chemical modification step may be performed before the mechanical unbraiding step or after the mechanical unbraiding step.

As for raw material, wood particles are suitably used as described above.

Hereinafter, the method for manufacturing a nanofiber sheet according to the present invention is described on a step-by-step basis.

Note that although the following description illustrates an exemplary manufacturing method in which a nanofiber sheet is produced with wood particles as the raw material, namely, the nanofiber precursor, the method for manufacturing a nanofiber sheet according to the present invention allows using any material other than wood particles as the raw material as long as the physical surface-smoothing treatment step provides any type of nanofiber sheet according to the present invention, in other words, any type of nanofiber sheet that satisfies the characteristics described above.

<Defatting Step>

The defatting step is preferably a step in which extraction is performed in any kind of organic solvent. Among others, an ethanol-benzene mixture is particularly suitably used as this organic solvent. More specifically, methanol-toluene mixtures have the advantage of powerful elution and thus are preferable.

The defatting step with a methanol-toluene mixture is performed as follows. First, wood particles are put into an extraction thimble. Then, a methanol-toluene mixture (methanol: toluene=1:2 (v/v)) is poured into a flask for a Soxhlet extractor. The extractor is assembled, and extraction is performed in a water bath for six hours. In this operation, heating is performed in such a manner that the solvent should boil slowly and flow through the siphon tube and turn back to the flask once about ten minutes. After the completion of extraction treatment, the solvent is distilled on the water bath for collection, and then the obtained residual is air-dried.

This step is aimed at removing lipid-soluble impurities, which are contained in materials like wood particles at a few percent or less. If the removal of lipid-soluble impurities is insufficient, problems such as discoloration on high-temperature treatment, deterioration with time, insufficient suppression of thermal expansion, and a lowered modulus of elasticity may occur.

<Lignin Removal Step>

The lignin removal step is preferably a step in which wood particles are immersed in an oxidizing agent. Sodium chlorite aqueous solution is particularly suitably used as this oxidizing agent.

Among such lignin removal treatments, Wise's method, in which sodium chlorite and acetic acid are used, has the advantages of simple operations and applicability to a large amount of wood particles and thus is preferable.

The removal of lignin according to Wise's method is carried out as follows. First, 600 ml of distilled water, 4 g of sodium chlorite, and 0.8 g of acetic acid are added per 10 g of the raw material wood particles. Then, the mixture is warmed under occasional stirring in a water bath at 70 to 80° C. for one hour. One hour later, with no cooling of the mixture, 4 g of sodium chlorite and 0.8 g of acetic acid are added, and the same treatment cycle is performed once again. This treatment cycle is repeated until the wood particles get bleached. For example, the same operations are repeated a total of four or more times for coniferous wood and a total of three or more times for broadleaf tree wood.

Note that the concentrations and amounts of reagents, the concentration for treatment, and the duration of treatment specified above are just an exemplary set of conditions; the conditions are never limited to them.

Other methods for removing lignin include, for example, the multi-step treatment used in the pulp manufacturing process, which includes chlorine treatment and alkali extraction, chlorine dioxide bleaching, oxide bleaching with the presence of an alkali, and so forth. However, chlorine treatment leads to a reduced degree of polymerization of cellulose and thus is desirably avoided.

Preferably, this lignin removal treatment is performed under treatment conditions adjusted appropriately so that the resultant nanofiber sheet can be obtained with the above-specified lignin content ratio.

<Washing Step>

The washing step, which comes after the lignin removal treatment described above, is performed by, for example, collecting the wood particles immersed in the sodium chlorite treatment liquid by suction filtration and washing them with water under suction. The amount of water used here for water washing is any amount in which water can neutralize the wood particles; for example, 2 L of water is used per 10 g of wood particles.

<Hemicellulose Removal Step>

The hemicellulose removal step is preferably a step in which wood particles are immersed in any kind of alkali. Potassium hydroxide aqueous solution is suitably used as this alkali.

When the alkali used for the removal of hemicellulose is too strong, cellulose crystals may be dissolved or denatured, and when it is too weak, the effect of removing hemicellulose cannot be produced. For potassium hydroxide aqueous solution, therefore, it is preferable to use a solution with a concentration in the range of 1 to 10 weight %, in particular, on the order of 2 to 8 weight %.

Sodium hydroxide aqueous solution may be used instead as long as it is a dilute solution. However, sodium hydroxide is more likely to denature cellulose crystals than potassium hydroxide is, and thus potassium hydroxide aqueous solution is preferably used.

The duration of immersion depends on the concentration of the alkali. For example, when 2 weight % potassium hydroxide aqueous solution is used, hemicellulose can be removed by an overnight immersion at room temperature and subsequent heating at 80° C. for two hours.

Preferably, this hemicellulose removal treatment is performed under treatment conditions adjusted appropriately so that the resultant nanofiber sheet can be obtained with the above-specified hemicellulose content ratio.

<Water-washing Step>

The water-washing step, which comes after the hemicellulose removal step, is performed by, for example, collecting the wood particles immersed in the alkali by suction filtration and washing them with water under suction. The amount of water used here for water washing is any amount in which water can neutralize the wood particles; for example, 2 L or more of water is used per 10 g of wood particles.

<Mechanical Unbraiding Step>

In the mechanical unbraiding step, it is preferable that a solution or dispersion of the nanofiber precursor with a solid content ratio in the range of 0.1 to 5 weight % is used. More preferably, the solid content ratio is in the range of 0.1 to 3 weight %. With too high a solid content ratio, the nanofiber precursor solution or dispersion loses its fluidity before or during unbraiding, and this leads to insufficient unbraiding. Too low a solid content ratio leads to a poor efficiency of unbraiding and thus is inappropriate in industrial settings.

Preferably, mechanical unbraiding is performed using a grinder or a combination of a grinder and any other device.

Grinders are millstone-like pulverizing equipment in which a raw material passes through the gap between two grinders (whetstones), the upper one and the lower one, and the impact, centrifugal force, and shear force thereby generated pulverize the raw material into ultrafine particles. With such a grinder, shearing, trituration, atomization, dispersion, emulsification, and fibrillation can be also performed at the same time as pulverization. Means other than the grinder include homogenizers, refiners, and so forth. However, it is difficult to unbraid a raw material into uniform and nano-sized fragments with a refiner or a homogenizer only. Usually, it is preferable to perform grinder treatment only or perform grinder treatment first and then refiner/homogenizer treatment.

Mechanical unbraiding with a grinder is performed using opposing flat whetstones and preferably under the following conditions:

Gap width between the whetstones: equal to or smaller than 1 mm, preferably equal to or smaller than 0.5 mm, and more preferably equal to or smaller than 0.3 mm; equal to or greater than 0.001 mm, preferably equal to or greater than 0.01 mm, more preferably equal to or greater than 0.05 mm, and the most preferably equal to or greater than 0.1 mm;

Whetstone diameter: between 10 cm and 100 cm, inclusive, and preferably equal to or shorter than 50 cm;

The number of whetstone revolutions: equal to or more than 500 rpm, more preferably equal to or more than 1000 rpm, and the most preferably equal to or more than 1500 rpm; equal to or less than 5000 rpm, preferably equal to or less than 3000 rpm, and the most preferably equal to or less than 2000 rpm;

Retention time, for which wood particles stay between the whetstones: 1 to 30 minutes, more preferably 5 to 25 minutes, and the most preferably 10 to 20 minutes;

Treatment temperature: 30 to 90° C., preferably 40 to 80° C., and more preferably 50 to 70° C.

Any gap width between the whetstones less than the value specified above, any diameter exceeding the value specified above, any number of revolutions exceeding the value specified above, and any retention time exceeding the value specified above are all unfavorable because unbraiding under such conditions may reduce the degree of crystallinity of cellulose and deteriorate the characteristics of the resultant nanofiber sheet, such as a high modulus of elasticity and suppressed thermal expansion.

Any gap with between the whetstones exceeding the value specified above, any diameter shorter than the value specified above, any number of revolutions less than the value specified above, and any retention time shorter than the value specified above all lead to incomplete processing of the raw material into nanofiber.

Also, any temperature for unbraiding treatment exceeding the value specified above may cause wood particles to boil, thereby reducing the unbraiding efficiency and/or causing cellulose crystals to deteriorate. When the temperature for unbraiding treatment is lower than the value specified above, the unbraiding efficiency is poor.

<Sheet-making Step>

After the completion of the mechanical unbraiding step described above, the obtained hydrous nanofiber is processed into a sheet, and then dehydrated until the water content ratio therein is lower than 3 weight %. In this way, a nanofiber sheet is obtained.

There is no particular limitation on the method used for this dehydration process. Examples thereof include a method in which water is removed to some extent by filtration, natural evaporation, cold pressing, or some other means and then the remaining portion of water is completely removed by natural evaporation, hot pressing, or some other means, a method composed of cold pressing and subsequent oven- or air-drying for an almost complete removal of water, and other similar methods.

The "filtration" mentioned above refers to any method in which water is removed using, for example, vacuum filtration equipment.

The "natural evaporation" mentioned above as a method for removing water to some extent refers to any method in which water is allowed to dissipate slowly with time.

The "cold pressing" mentioned above refers to any method in which water is extracted by pressing with no heat applied. By cold pressing, water can be squeezed out to some extent. The pressure used in cold pressing here is preferably in the range of 0.01 to 10 MPa and more preferably in the range of 0.1 to 3 MPa. Cold pressing at any pressure lower than 0.01 MPa often results in the consequence that a large amount of water remains, but cold pressing at any pressure higher than 10 MPa may break the nanofiber sheet. As for temperature, there is no particular limitation; however, room temperature is preferred for convenience in operation.

The "natural evaporation" mentioned above as a method for almost completely removing the remaining portion of water refers to any method in which nanofiber is dried over time.

The "hot pressing" mentioned above refers to any method in which water is extracted by pressing with heat applied. By hot pressing, the remaining portion of water can be almost completely removed. The pressure used in hot pressing here is preferably in the range of 0.01 to 10 MPa and more preferably in the range of 0.2 to 3 MPa. Hot pressing at any pressure lower than 0.01 MPa may end up with an incomplete removal of water, but hot pressing at any pressure higher than 10 MPa may result in the consequence that a damaged nanofiber sheet is obtained. The temperature is preferably in the range of 100 to 300° C. and more preferably in the range of 110 to 200° C. When the temperature is lower than 100° C., it takes a long time to remove water. However, any temperature higher than 300° C. may cause decomposition of cellulose fiber and other problems.

Likewise, the temperature for the oven-drying process mentioned above is preferably in the range of 100 to 300° C. and more preferably in the range of 110 to 200° C. When the drying temperature is lower than 100° C., the removal of water may be impossible. However, any drying temperature higher than 300° C. may cause decomposition of cellulose fiber and other problems.

To have a low porosity, the nanofiber sheet preferably goes through any pressing process. Also, for the purpose of further reducing the coefficient of thermal expression of the nanofiber sheet, hot pressing is more preferable. This is because hot pressing further strengthens hydrogen bonds formed in entangled parts of fiber.

<Chemical Modification Step>

The step of chemically modifying hydroxy groups of cellulose in the nanofiber sheet obtained by sheet-making is preferably a step in which hydroxy groups existing on cellulose filaments in nanofiber are chemically modified using one or two or more kinds selected from the group consisting of acids, alcohols, halogenizing reagents, acid anhydrides, and isocyanates in order that hydrophobic functional groups are introduced via any one or more kinds of ether bonds, ester bonds, and urethane bonds.

Note that hereinafter a nanofiber sheet in which some of hydroxy groups of cellulose are chemically modified is referred to as a "derivatized nanofiber sheet."

In the present invention, examples of the functional group introduced by chemical modification to replace hydroxy groups of cellulose include acetyl group, methacryloyl group, propanoyl group, butanoyl group, iso-butanoyl group, pentanoyl group, hexanoyl group, heptanoyl group, octanoyl group, nonanoyl group, decanoyl group, undecanoyl group, dodecanoyl group, myristoyl group, palmitoyl group, stearoyl group, pivaloyl group, 2-methacryloyloxyethylisocyanoyl group, methyl group, ethyl group, propyl group, isopropyl group, butyl group, iso-butyl group, tert-butyl group, pentyl group, hexyl group, heptyl group, octyl group, nonyl group, decyl group, undecyl group, dodecyl group, myristyl group, palmityl group, stearyl group, and other similar groups. One or two or more kinds of these functional groups may be introduced to replace hydroxy groups of cellulose fiber.

Among others, ester functional groups are particularly preferable. In particular, an acetyl group or some other acyl group and/or a methacryloyl group are preferable.

Also, when any relatively bulky functional group(s), such as methacryloyl group, pivaloyl group, long-chain alkyl groups, long-chain alkanoyl groups, and 2-methacryloyloxyethylisocyanoyl group, is introduced, it is difficult to chemically modify hydroxy groups of cellulose only with the bulky functional group(s) at a high degree of substitution. When such bulky functional group(s) is introduced, therefore, it is preferable that the bulky functional group(s) is introduced first and then chemical modification is performed once again to introduce compact functional group(s), such as acetyl group, propanoyl group, methyl group, and ethyl group, to replace some other hydroxy groups for a higher degree of substitution.

Incidentally, specific examples of the chemical modifier used to introduce one or more kinds of the above-listed functional groups, which is one or two or more kinds selected from the group consisting of acids, alcohols, halogenizing reagents, acid anhydrides, and isocyanates, are as follows.

TABLE 1

| Functional group introduced | Chemical modifiers |
|---|---|
| Acetyl group | Acetic acid, acetic anhydride, acetyl halides |
| Methacryloyl group | Methacrylic acid, methacrylic anhydride, methacryloyl halides |
| Propanoyl group | Propanoic acid, propanoic anhydride, propanoyl halides |
| Butanoyl group | Butanoic acid, butanoic anhydride, butanoyl halides |
| Iso-butanoyl group | Iso-butanoic acid, iso-butanoic anhydride, iso-butanoyl halides |
| Pentanoyl group | Pentanoic acid, pentanoic anhydride, pentanoyl halides |
| Hexanoyl group | Hexanoic acid, hexanoic anhydride, hexanoyl halides |
| Heptanoyl group | Heptanoic acid, heptanoic anhydride, heptanoyl halides |
| Octanoyl group | Octanoic acid, octanoic anhydride, octanoyl halides |
| Nonanoyl group | Nonanoic acid, nonanoic anhydride, nonanoyl halides |

TABLE 1-continued

| Functional group introduced | Chemical modifiers |
|---|---|
| Decanoyl group | Decanoic acid, decanoic anhydride, decanoyl halides |
| Undecanoyl group | Undecanoic acid, undecanoic anhydride, undecanoyl halides |
| Dodecanoyl group | Dodecanoic acid, dodecanoic anhydride, dodecanoyl halides |
| Myristoyl group | Myristic acid, myristic anhydride, myristyl halides |
| Palmitoyl group | Palmitic acid, palmitic anhydride, palmityl halides |
| Stearoyl group | Stearic acid, stearic anhydride, stearyl halides |
| Pivaloyl group | Pivalic acid, pivalic anhydride, pivaloyl halides |
| 2-Methacryloyloxyethylisocyanoyl group | 2-Methacryloyloxyethylisocyanic acid |
| Methyl group | Methyl alcohol, methyl halides |
| Ethyl group | Ethyl alcohol, ethyl halides |
| Propyl group | Propyl alcohol, propyl halides |
| Iso-propyl group | Iso-propyl alcohol, iso-propyl halides |
| Butyl group | Butyl alcohol, butyl halides |
| tert-butyl group | tert-butyl alcohol, tert-butyl halides |
| Pentyl group | Pentyl alcohol, pentyl halides |
| Hexyl group | Hexyl alcohol, hexyl halides |
| Heptyl group | Heptyl alcohol, heptyl halides |
| Octyl group | Octyl alcohol, octyl halides |
| Nonyl group | Nonyl alcohol, nonyl halides |
| Decyl group | Decyl alcohol, decyl halides |
| Undecyl group | Undecyl alcohol, undecyl halides |
| Dodecyl group | Dodecyl alcohol, dodecyl halides |
| Myristyl group | Myristyl alcohol, myristyl halides |
| Palmityl group | Palmityl alcohol, palmityl halides |
| Stearyl group | Stearyl alcohol, stearyl halides |

The chemical modification of cellulose can be performed in any ordinary method. For example, a method in which the above-described nanofiber sheet is immersed in any solution containing a chemical modifier and retained there under appropriate conditions for a predetermined period of time and other similar methods can be used.

In this case, the reaction solution containing a chemical modifier may consist only of the chemical modifier and a catalyst or be solution of the chemical modifier. There is no particular limitation on the solvent used to dissolve the chemical modifier and the catalyst as long as it is not water, a primary alcohol, or a secondary alcohol. As for the catalyst, basic catalysts such as pyridine, N,N-dimethylaminopyridine, triethylamine, sodium hydride, tert-butyl lithium, lithium diisopropylamide, potassium tert-butoxide, sodium methoxide, sodium ethoxide, sodium hydroxide, and sodium acetate as well as acidic catalysts such as acetic acid, sulfuric acid, and perchloric acid can be used. Considering the speed of reaction velocity and for preventing a reduced degree of polymerization, it is preferable to use pyridine or any other basic catalyst. Sodium acetate is also preferable in that it is free from the problem of discoloring the nanofiber sheet by chemical modification and that it achieves a high degree of substitution by its high reaction temperature. Perchloric acid or sulfuric acid is also preferable in that they are free from the problem of discoloring the nanofiber sheet by chemical modification and that they achieve a high degree of substitution even under reaction conditions of room temperature, a short period of time, and a small amount of the chemical modifier. When the reaction solution is a solution of the chemical modifier, the concentration of the chemical modifier in the reaction solution is preferably in the range of 1 to 75 weight %. In the presence of any basic catalyst, the concentration of the chemical modifier in the reaction solution is more preferably in the range of 25 to 75 weight %. In the presence of any acidic catalyst, the concentration of the chemical modifier in the reaction solution is more preferably in the range of 1 to 20 weight %.

As for the temperature condition of this chemical modification treatment, too high a temperature causes yellowed cellulose fiber, a low degree of polymerization, and other concerns, whereas too low a temperature leads to a low reaction rate. Thus, it is appropriate that the temperature is on the order of 40 to 100° C. under basic conditions and in the range of 10 to 40° C. under acidic conditions. In this chemical modification treatment, the nanofiber sheet may be allowed to stand under vacuum conditions with a pressure as low as 1 kPa for about one hour so that the fine structure therein can be well impregnated with the reaction solution for a higher efficiency of contact between nanofiber and the chemical modifier. In addition, the reaction time is appropriately determined in accordance with the reaction liquid used and the reaction rate, which depends on the treatment conditions for the liquid; however, it is usually on the order of 24 to 336 hours under basic conditions and on the order of 0.5 to 12 hours under acidic conditions.

The nanofiber sheet obtained in the above-described chemical unbraiding and sheet-making steps, the fiber of which has crossovers and contact points, may be insufficiently permeable to the above-described reaction liquid containing a chemical modifier, and this may reduce the reaction rate of chemical modification.

To solve this problem, in the present invention, it is preferable that in the above-described sheet-making step, the water-containing nanofiber sheet, or the nanofiber sheet that has not been processed by water removal treatment yet, undergoes cold pressing to an extent necessary for partial removal of water so that the resultant nanofiber sheet should contain a small amount of water (the first step), water remaining in this hydrous nanofiber sheet is replaced with any appropriate kind of organic solvent (the first organic solvent) (the second step), and then the nanofiber sheet containing this organic solvent is brought into contact with the reaction liquid so that the nanofiber sheet can be efficiently impregnated with the reaction liquid (the third step). In this way, the efficiency of contact between nanofiber and the reaction liquid can be improved, and thus the reaction rate of chemical modification can be increased.

The first organic solvent used here is preferably any kind of organic solvent that can be uniformly mixed with water and the reaction liquid containing a chemical modifier for smooth replacement of water existing in the hydrous nanofiber sheet with the first organic solvent and then with the reaction liquid containing a chemical modifier and that has a lower boiling point than water and the reaction liquid. In particular, alcohols such as methanol, ethanol, propanol, and isopropanol, ketones such as acetone, ethers such as tetrahydrofuran and 1,4-dioxane, amides such as N,N-dimethylacetamide and N,N-dimethylformamide, carboxylic acids such as acetic acid, nitriles such as acetonitrile, and other kinds of water-soluble organic solvents such as pyridine or other kinds of aromatic heterocyclic compounds are preferable. In light of availability, ease in handling, and other conveniences, ethanol, acetone, and other similar organic solvents are preferable. These organic solvents may be used alone or in combination of two or more kinds.

There is no particular limitation on the method for replacing water existing in the hydrous nanofiber sheet with the first organic solvent. An exemplary method is one in which water existing in the nanofiber sheet is replaced with the first organic solvent by immersing the hydrous nanofiber sheet in the first organic solvent and allowing it to stand for a predetermined period of time so that water existing in the hydrous nanofiber sheet effuses into the first organic solvent and then changing the first organic solvent, which now contains the water effusion, to a pure one as needed. As for the temperature condition of this process of replacement by immersion, the temperature is preferably on the order of 0 to 60° C. so that the first organic solvent can be prevented from volatilizing. Usually, this process is performed at room temperature.

In addition, for an efficient replacement of water existing in the hydrous nanofiber sheet with the first organic solvent, it is preferable that the hydrous nanofiber sheet undergoes cold pressing before replacement of water with the first organic solvent so that some portion of water contained in the nanofiber sheet should be removed.

The extent of this pressing process is chosen in such a manner that this process and another pressing process preceding the impregnation of the derivatized nanofiber sheet, which will be described later, with a liquid material for impregnation should provide the resultant fiber-reinforced composite material with an intended fiber content ratio. In general, it is preferable that pressing reduces the thickness of the hydrous nanofiber sheet to about ½ to 1/20 of the initial thickness. The pressure and the retention time for this cold pressing process is appropriately chosen from the range of 0.01 to 100 MPa (note that pressing at a pressure equal to or higher than 10 MPa may break the nanofiber sheet and thus should be performed with the pressing speed reduced and other necessary measures taken) and from the range of 0.1 to 30 minutes, respectively, in accordance with the extent of pressing. As for pressing temperature, the temperature is preferably on the order of 0 to 60° C. for the same reason as for the temperature condition of the above-described process of replacing water with organic solvent; however, usually, this process is performed at room temperature. The hydrous nanofiber sheet whose thickness has been reduced by this pressing treatment maintains a near constant thickness even after the replacement of water with the first organic solvent. Note that this pressing process is not always necessary; the hydrous nanofiber sheet may be directly immersed in the first organic solvent for the replacement of water with the first organic solvent.

After water existing in the nanofiber sheet is replaced with the first organic solvent in the way described above, the nanofiber sheet containing the organic solvent is immersed in the above-described reaction liquid for chemical modification. The treatment conditions used here are the same as those for the chemical modification treatment of the nanofiber sheet from which water has been removed, which are already specified above. Thanks to an improved reaction rate, however, the duration of treatment is on the order of 12 to 118 hours under basic conditions and on the order of 0.3 to 3 hours under acidic conditions.

This chemical modification is performed to the extent that hydroxy groups of cellulose are chemically modified until the degree of substitution specified above is reached.

<Physical Surface-Smoothing Treatment Step>

Examples of the method for physical surface-smoothing treatment of the nanofiber sheet obtained in the way described above include, but not particularly limited to, polishing, pressing, and so forth.

The "polishing" mentioned above refers to any method in which depressions and projections are removed from the sheet using sandpaper, emery paper, or any other kind of sander until its surfaces are smooth.

Also, the "pressing" mentioned above refers to any method in which the sheet is inserted between plates or rollers and compressed until its surfaces are smooth.

Specifically, the sandpaper used for surface smoothing by polishing is any product falling within the range of #4000 to #20000 (particle size: 3 to 0.1 μm). As for emery paper, specific examples are Sankyo Rikagaku's products falling within the range of #4000 to #20000 (particle size: 3 to 0.1 μm).

When the surface smoothing of the sheet is performed by polishing, the extent of polishing is preferably any extent that the superficial portion is removed by polishing from each surface of the sheet by, for example, 100 to 1400 nm in thickness, although the preferable extent of polishing depends on the pre-polishing surface smoothness of the sheet. Note that polishing may be performed only on either one surface of the nanofiber sheet; however, preferably, polishing is performed on both surfaces of the nanofiber sheet.

Also, when the surface smoothing of the sheet is performed by pressing, it is preferable that the level of compression force is appropriately controlled. Too weak a compression force leads to incomplete surface smoothing, whereas too strong a compression force may damage the sheet.

In addition, heating may be used in combination with compression. In this case, the heating temperature is preferably in the range of 40 to 160° C., in particular, 80 to 120° C. Too low a heating temperature leads to an insufficient effect of smoothing by heating, whereas too high a heating temperature may cause thermal deterioration of the sheet.

This physical surface-smoothing treatment step is performed in such a manner that the average surface roughness (Ra) and the maximum difference in height on surface of the nanofiber sheet according to the present invention should be the average surface roughness (Ra) and the maximum difference in height on surface specified above.

[Applications]

The nanofiber sheet according to the present invention can have a high degree of transparency without being processed with a matrix material into a composite material. Thus, decreases in the modulus of elasticity and increases in the coefficient of linear thermal expansion, which have been inevitable in composite materials containing a nanofiber sheet and a matrix material, can now be prevented. Furthermore, the nanofiber sheet requires no step of processing into a composite material, and this improves the manufacturing efficiency and reduces the manufacturing cost.

In addition, the nanofiber sheet according to the present invention can be used in the application of composite materials containing the sheet and transparent resin.

The nanofiber sheet according to the present invention, which features a high degree of transparency, a high modulus of elasticity, a high strength, heat resistance, and a low specific gravity property, is effective for the use as a substrate material for printed-circuit boards, a material of windows for moving objects, a basal sheet for organic devices, in particular, a sheet for flexible OLEDs, a surface-emitting illuminating sheet, a sheet for thin-film solar cells, and so forth. Among other characteristics, the high intensity of ultraviolet light transmitted through the nanofiber sheet makes the nanofiber sheet effective for the use as a substrate for solar cells with which high-energy wavelengths are used. Furthermore, the nanofiber sheet can be applied to flexible optical waveguide substrates and LCD substrates and is also effective for applications in which transistors, transparent electrodes, passivation films, gas-barrier films, metal films, and other inorganic or metal materials or precision structures are formed on the sheet, in particular, those in which a roll-to-roll process is used for production.

EXAMPLES

Hereinafter, the present invention is described in more detail with reference to examples and comparative examples thereof; however, the present invention is never limited to the examples described below. The methods the inventors used to characterize the nanofiber sheets and the fiber-resin composite materials are as follows.

[Transmittance for all Rays of Light]

<Measuring Apparatus>

"UV-4100 Spectrophotometer" manufactured by Hitachi High-Technologies Corporation (a solid sample measurement system) was used.

<Measuring Conditions>

A light-source mask 6 mm×6 mm in size was used.

Each test specimen was positioned in the opening of the integrating sphere, and then photometry was performed. With the test specimen in this position, both diffuse transmitted light and linear transmitted light reach the photodetector located in the integrating sphere, and thus the transmittance for all rays of light can be measured.

No reference sample was used. With no reference (reflection that occurs due to the difference in refractive index between the sample and the air; in case of Fresnel reflection, the transmittance for parallel rays of light never reaches 100%), Fresnel reflection causes some loss in transmittance.

Light source: An iodine-tungsten lamp

Wavelengths for measurement: 1000 to 190 nm

[Transmittance for Parallel Rays of Light]

<Measuring Apparatus>

Same as above

<Measuring Conditions>

Same as above

However, each test specimen was positioned 22 cm away from the integrating sphere before photometry. With the test specimen in this position, diffuse transmitted light is removed, and only parallel rays of light (linear transmitted light) reach the photodetector in the integrating sphere.

[Coefficient of Linear Thermal Expansion]

The coefficient of linear thermal expansion was measured in accordance with the method specified in ASTM D 696. Measurement was performed in "TMA/SS6100" manufactured by Seiko Instruments, Inc. under the following measuring conditions.

<Measuring Conditions>

Heating rate: 5° C./min

Atmosphere: In $N_2$

Heating temperature: 20 to 150° C.

Load: 3 mg

The number of scans: 3 scans

Sample length: 3×20 mm

Mode: Tension mode

[Young's Modulus]

With reference to JIS K7161, plates shaped to have a width of 5 mm, a length of 50 mm, and a thickness of 50 μm were subjected to tensile test with the rate of deformation set at 5 mm/min. Then, the Young's modulus was determined from the stress to the strain under the conditions of proportionality limit or milder conditions.

In addition, the thickness was measured using a dial gauge.

[Tensile Strength]

With test specimens each having a thickness of 50 μm, a width of 5 mm, and a length of 50 mm, the tensile strength was measured in accordance with the method specified in JIS K7161 with the rate of deformation set at 5 mm/min.

[Average Surface Roughness (Ra)/Maximum Difference in Height on Surface]

The average surface roughness (Ra) and the maximum difference in height were determined in the following way: With an SPI 3800N scanning probe microscope (manufactured by SII NanoTechnology Inc.) set in the DFM mode, the surface roughness on a 20-μm square was scanned for each sheet.

Note that the presented values of the average surface roughness (Ra) and the maximum difference in height on surface are measurements on either one surface of each sheet. For the sheets prepared as Examples and Comparative Examples detailed below, however, the average surface roughness (Ra) and the maximum difference in height on surface are both equivalent on both surfaces.

[Cellulose Content Ratio]

For each sheet, the cellulose content ratio was calculated for the materials used for preparing it.

As for the lignin content ratio and other remaining properties and characteristics, measurement was performed in the way described above. The presented density values are calculations from the volume and the weight of the test specimens.

Example 1

First, 70 g of radiatana pine wood particles having a major axis of 500 μm, a major axis/minor axis ratio of 10, and a water content ratio of 5 weight % underwent defatting treatment in a methanol-toluene mixture (methanol:toluene=1:2 (v/v)). The resultant wood particles were put into a solution containing 2000 ml of distilled water, 50 g of sodium chlorite, and 5 ml of acetic acid, and then the obtained mixture was warmed under occasional stirring in a water bath at 70 to 80° C. for one hour. One hour later, with no cooling of the mixture, 50 g of sodium chlorite and 5 ml of acetic acid were added, and the same treatment cycle was performed once again. This treatment cycle was repeated five times.

After that, the obtained product was washed in about 10 L of cold water.

Then, the wood particles were immersed in 2 weight % potassium hydroxide aqueous solution. After being allowed to stand overnight at room temperature, the wood particles were heated at 80° C. for two hours and then collected by suction filtration. The collected wood particles were washed under suction in about 10 L of water until the washing was neutral.

The resultant wood particles, for which the lignin removal and hemicellulose removal treatments was completed in the way described above, were mechanically unbraided by grinder treatment under the conditions specified below. The grinder treatment was performed only once.

<Grinder Treatment>

Grinder model used: "Cerendipitor" MKCA6-3 model, Masuko Sangyo Co., Ltd.

Whetstone grade: MKG-C 80#

Whetstone diameter: 15 cm

Gap width between whetstones: The whetstones were brought into full contact with each other, and then the upper one was lifted by 200 μm. Determined with the surface roughness on the whetstones averaged, the surface-to-surface gap width was 200 μm.

Revolution speed: 1500 rpm

Retention time per treatment cycle: 15 minutes per liter

Temperature: 50 to 60° C.

Until this grinder treatment, the minimum water content ratio in the wood particles was 5 weight %.

The obtained hydrous nanofiber was conditioned in a suspension with a fiber content ratio of 0.1 weight %. The obtained suspension was filtered to remove water; as a result, a sheet-like material was obtained. Then, the sheet-like material was hot-pressed at 15 kPa and 55° C. for 72 hours so that water could be completely removed. In this way, a dry nanofiber sheet was obtained with a thickness of 60 μm and a porosity of 3.8%.

The obtained nanofiber sheet was polished on both surfaces using emery paper (micro-finishing films manufactured by Sankyo-Rikagaku Co., Ltd.) falling within the range of #4,000 to #20,000 until the average surface roughness (Ra) was 19 nm. This polishing process removed a superficial portion from both surfaces of the nanofiber sheet by about 1 μm in thickness.

For the nanofiber sheet obtained in this way, measured characteristics are presented in Table 2.

Example 2

A nanofiber sheet was produced in the same way as in Example 1 except that the average surface roughness (Ra) reached after the nanofiber sheet from which water has been removed was polished on both surfaces using emery paper (micro-finishing films manufactured by Sankyo-Rikagaku Co., Ltd.) falling within the range of #4,000 to #20,000 was 42 nm. For the nanofiber sheet obtained in this way, measured characteristics are presented in Table 2. This polishing process removed a superficial portion having a thickness of about 1 μm from both surfaces of the nanofiber sheet.

Comparative Example 1

The nanofiber sheet prepared in Example 1 was characterized before surface smoothing with emery paper. Measured characteristics are presented in Table 2.

Comparative Example 2

A nanofiber sheet was prepared in the same way as in Example 1 except that lyophilization was used to remove water from the aqueous suspension of the grinder-treated hydrous nanofiber having a fiber content ratio of 0.1 weight %. The obtained dry nanofiber sheet had a thickness of 120 μm and a porosity of 59%. For this product, measured characteristics are presented in Table 2.

Comparative Example 3

A nanofiber sheet was prepared in the same way as in Example 1 except the following: A sheet-like material was obtained by filtration of the suspension of the grinder-treated hydrous nanofiber having a fiber content ratio of 0.1 weight %, and then alcohols such as methanol and ethanol were poured down onto the obtained sheet under filtration for replacement of water with the alcohols; then, the obtained product was hot-pressed at 15 kPa and 55° C. for 72 hours so that water could be completely removed. In this way, a dry nanofiber sheet was obtained with a thickness of 90 μm and a porosity of 25%.

The obtained nanofiber sheet was allowed to stand under a reduced pressure in acrylic resin (TCDDMA) containing a photoinitiator for 12 hours. After that, the resin-impregnated nanofiber sheet was irradiated with ultraviolet light using a belt-conveyer-type UV irradiation apparatus (Fusion F300 and LC6B benchtop conveyor, both manufactured by Fusion Systems, Inc.) until the resin cured. The total amount of irradiation energy was 20 J/cm$^2$. Then, annealing (heating treatment) was performed in vacuum at 160° C. for two hours; as a result, a fiber-reinforced composite material was obtained. For this product, measured characteristics are presented in Table 2.

Comparative Example 4

A nanofiber sheet was prepared in the same way as in Example 1 except the following: The wood particles that completed the defatting, lignin removal, and hemicellulose removal treatments (purified wood particles) underwent acetylation treatment as described below.

<Acetylation Treatment>

1) The purified wood particles were immersed in acetone until water existing in the wood particles was completely removed.

2) A reaction solution was prepared by adding 25 mL of acetic anhydride, 400 mL of acetic acid, 500 mL of toluene, and 2.5 mL of perchloric acid into a separable flask.

3) The purified wood particles obtained in 1) were immersed in the reaction solution prepared in 2), and reaction was allowed to proceed at room temperature for one hour.

4) After the completion of reaction, the obtained acetylated wood particles were washed in methanol until the reaction liquid existing in the wood particles was completely removed.

The obtained wood particles were conditioned in a 1 weight % aqueous suspension, and the obtained suspension was subjected to grinder treatment under the same conditions as in Example 1. Until this grinder treatment, the minimum water content ratio in the wood particles was 0 weight %.

The obtained hydrous nanofiber was conditioned in a suspension with a fiber content ratio of 0.1 weight %. The obtained suspension was filtered to remove water; as a result, a sheet-like material was obtained. Then, the sheet-like material was hot-pressed at 15 kPa and 55° C. for 72 hours so that water could be completely removed. In this way, a dry nanofiber sheet was obtained with a thickness of 100 μm and a porosity of 25%.

The obtained nanofiber sheet was allowed to stand under a reduced pressure in acrylic resin (TCDDMA) containing a photoinitiator for 12 hours. After that, the resin-impregnated nanofiber sheet was irradiated with ultraviolet light using a belt-conveyer-type UV irradiation apparatus (Fusion F300 and LC6B benchtop conveyor, both manufactured by Fusion Systems, Inc.) until the resin cured. The total amount of irradiation energy was 20 J/cm$^2$. Then, annealing (heating treatment) was performed in vacuum at 160° C. for two hours; as a result, a fiber-reinforced composite material was obtained. For this product, measured characteristics are presented in Table 2.

Comparative Example 5

The nanofiber sheet obtained in Comparative Example 1 was coated with the acrylic resin used in Comparative Example 3 using a spin coater (MS-A100, Mikasa Co., Ltd.) for surface smoothing, and then the resin was allowed to cure under ultraviolet irradiation. The total amount of irradiation energy was 20 J/cm$^2$. Then, coating on the back surface and hardening of the resin were performed in the same way. Then, annealing (heating treatment) was performed in vacuum at 160° C. for two hours; as a result, a resin-coated cellulose-nanofiber transparent sheet was obtained (resin thickness: 20 μm per surface). For this product, measured characteristics are presented in Table 2.

Comparative Example 6

The nanofiber sheet obtained in Comparative Example 1 was sandwiched and laminated between two polystyrene sheets each having a thickness of 40 μm. Hot pressing was performed at 120° C. and 2 MPa for two minutes; as a result, a transparent composite material was obtained. For this product, measured characteristics are presented in Table 2.

TABLE 2

| | Test specimen | Young's modulus (GPa) | Tensile strength (MPa) | Coefficient of linear thermal expansion (ppm/K) | Cellulose content ratio (weight %) | Thickness (mm) | Density (g/cm$^3$) | Transmittance for all rays of light (%) Wavelength 250 nm | Wavelength 300 nm | Wavelength 600 nm |
|---|---|---|---|---|---|---|---|---|---|---|
| Example 1 | Low-porosity nanofiber sheet (polished) | 13 | 223 | 8.5 | 100 | 60 | 1.53 | 19.7 | 51.7 | 89.4 |
| Example 2 | Low-porosity nanofiber sheet (polished) | 13 | 223 | 8.5 | 100 | 60 | 1.53 | 18.1 | 50.1 | 89.0 |
| Comparative Example 1 | Low-porosity nanofiber sheet (non-polished) | 13 | 223 | 8.5 | 100 | 60 | 1.53 | 11.5 | 38.2 | 84.6 |
| Comparative Example 2 | High-porosity nanofiber sheet (non-polished) | 0.1 | 15 | 10.5 | 100 | 120 | 0.65 | 0 | 0.1 | 6.4 |
| Comparative Example 3 | Alcohol-substituted nanofiber composite material | 5.7 | 85 | 25 | 45 | 90 | 1.2 | 0 | 15.1 | 87.5 |
| Comparative Example 4 | Acetylated nanofiber composite material | 6.2 | 90 | 28 | 40 | 100 | 1.2 | 0 | 5.0 | 89.6 |
| Comparative Example 5 | Resin-coated nanofiber sheet | 10.5 | 130 | 18 | 60 | 60 | 1.3 | 0 | 4.1 | 88.5 |
| Comparative Example 6 | Polystyrene-laminated nanofiber sheet | 8.2 | 98 | 25 | 30 | 120 | 1.4 | 0 | 3.2 | 87.1 |

| | Transmittance for parallel rays of light (%) Wavelength 250 nm | Wavelength 300 nm | Wavelength 600 nm | Average surface roughness (Ra) (nm) | Maximum difference in height on surface (nm) |
|---|---|---|---|---|---|
| Example 1 | 7.6 | 26.0 | 71.6 | 19 | 249 |
| Example 2 | 7.3 | 21.0 | 70.6 | 42 | 639 |
| Comparative Example 1 | 0.3 | 1.3 | 6.7 | 150 | 1604 |
| Comparative Example 2 | 0 | 0 | 0 | — | — |
| Comparative Example 3 | 0 | 9.4 | 79.6 | — | — |
| Comparative Example 4 | 0 | 4.4 | 86.3 | — | — |
| Comparative Example 5 | 0 | 20.3 | 81.2 | — | — |
| Comparative Example 6 | 0 | 8.6 | 80.1 | — | — |

Table 2 demonstrates the following:

The nanofiber sheet according to Comparative Example 1, for which surface smoothing by polishing was omitted, had low transmittance values for both parallel rays of light and all rays of light and thus was poor in terms of transparency;

The nanofiber sheet according to Comparative Example 2, for which hot pressing was omitted in addition to surface smoothing by polishing, was inferior not only in transparency but also in strength and Young's modulus;

Comparative Example 3, a composite material obtained by replacing water existing in a nanofiber sheet with alcohols and then combining the sheet with transparent resin, had an improved degree of transparency but had a high coefficient of linear thermal expansion and was inferior in the modulus of elasticity and strength;

The nanofiber composite material according to Comparative Example 4, which was obtained by combining a chemically modified nanofiber sheet with transparent resin, the resin-coated nanofiber sheet according to Comparative Example 5, and the polystyrene-laminated nanofiber sheet according to Comparative Example 6 had a favorable transmittance value for parallel rays of light but had a poor transmittance value for all rays of light and were inferior in the coefficient of linear thermal expansion and strength.

On the other hand, the nanofiber sheet according to the present invention can have a high degree of transparency, a high modulus of elasticity, a high strength, and a weak tendency for linear thermal expansion without being processed with transparent resin into a composite material.

Although specific embodiments are used here for detailed description of the present invention, it is obvious to those skilled in the art that various modifications can be made without departing from the spirit and scope of the present invention.

This application is based on a Japanese patent application filed Jun. 30, 2008 (Japanese Patent Application No. 2008-169959), which is hereby incorporated by reference herein in its entirety.

The invention claimed is:

1. A nanofiber sheet, comprising:

a nonwoven fabric;

the nonwoven fabric comprising a nanofiber and no resin material, wherein the nanofiber sheet has a transmittance for parallel rays of light having a wavelength of 600 nm is equal to or higher than 70% at a thickness of 60 μm, a Young's modulus measured in accordance with the JIS K7161 method is equal to or greater than 10 GPa and a coefficient of linear thermal expansion measured in accordance with the ASTM D606 method is equal to or smaller than 10 ppm/K, and wherein the nanofiber sheet is manufactured by a method comprising a surface-smoothing treatment performed by polishing, and wherein the nanofiber sheet contains no resin material.

2. The nanofiber sheet according to claim 1, wherein an average surface roughness (Ra) is equal to or smaller than 90 nm on at least either one surface.

3. The nanofiber sheet according to claim 1, wherein a transmittance for all rays of light having a wavelength of 250 nm is equal to or higher than 5%.

4. The nanofiber sheet according to claim 1, wherein a content ratio of cellulose in the sheet is equal to or higher than 90 weight %.

5. The nanofiber sheet according to claim 1, wherein the nanofiber is obtained from wood particles.

6. The nanofiber sheet according to claim 4, wherein some of hydroxy groups of the cellulose have undergone a chemical modification.

7. The nanofiber sheet according to claim 6, wherein the chemical modification is performed using one or two or more kinds selected from the group consisting of acids, alcohols, halogenizing reagents, acid anhydrides, and isocyanates.

8. A method for manufacturing the nanofiber sheet according to claim 1, further comprising an unbraiding step for unbraiding a nanofiber precursor, wherein a water content ratio in the nanofiber precursor is equal to or higher than 3 weight % in all steps preceding the unbraiding step.

9. The method for manufacturing a nanofiber sheet according to claim 8, wherein the unbraiding step is a step in which a nanofiber precursor solution or dispersion having a solid content ratio in the range of 0.1 to 5 weight % is unbraided into nanofiber.

10. The method for manufacturing a nanofiber sheet according to claim 8, further comprising, before the unbraiding step, a lignin removal step in which the nanofiber precursor is immersed in an oxidizing agent.

11. The method for manufacturing a nanofiber sheet according to claim 8, further comprising a drying step for drying the nanofiber obtained in the unbraiding step until the water content ratio is lower than 3 weight %.

12. The method for manufacturing a nanofiber sheet according to claim 8, further comprising a hemicellulose removal step in which the nanofiber precursor is immersed in an alkali.

13. The method for manufacturing a nanofiber sheet according to claim 8, further comprising a sheet-making step for processing the nanofiber obtained in the unbraiding step into a sheet.

14. The method for manufacturing a nanofiber sheet according to claim 8, further comprising a chemical modification step for chemically modifying some of hydroxy groups of the cellulose obtained in the unbraiding step.

* * * * *